US009225116B2

(12) United States Patent
McKibben

(10) Patent No.: US 9,225,116 B2
(45) Date of Patent: Dec. 29, 2015

(54) QUICK CONNECT POWER CONNECTOR ISOLATING SYSTEM

(71) Applicant: TYCO ELECTRONICS CORPORATION, Berwyn, PA (US)

(72) Inventor: John Louis McKibben, Dallastown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/325,407

(22) Filed: Jul. 8, 2014

(65) Prior Publication Data

US 2015/0031247 A1 Jan. 29, 2015

Related U.S. Application Data

(60) Provisional application No. 61/857,532, filed on Jul. 23, 2013.

(51) Int. Cl.

| | |
|---|---|
| ***H01R 13/645*** | (2006.01) |
| ***H01R 13/20*** | (2006.01) |
| ***H01R 13/641*** | (2006.01) |
| ***H01R 13/642*** | (2006.01) |
| *H01R 11/28* | (2006.01) |
| *H01R 13/187* | (2006.01) |
| *H01R 13/46* | (2006.01) |
| *H01R 13/627* | (2006.01) |

(52) U.S. Cl.

CPC ..... *H01R 13/645* (2013.01); *H01R 13/20* (2013.01); *H01R 13/641* (2013.01); *H01R 13/642* (2013.01); *H01R 11/282* (2013.01); *H01R 13/187* (2013.01); *H01R 13/465* (2013.01); *H01R 13/6275* (2013.01); *H01R 13/6277* (2013.01)

(58) Field of Classification Search

USPC ..... 439/681, 347, 354, 352, 370

See application file for complete search history.

(56) References Cited

U.S. PATENT DOCUMENTS

| | | | | |
|---|---|---|---|---|
| 4,042,759 | A * | 8/1977 | Cella | 429/121 |
| 4,590,540 | A * | 5/1986 | Nicholson et al. | 361/679.61 |
| 5,435,742 | A * | 7/1995 | Cecil, Jr. | 439/347 |

(Continued)

FOREIGN PATENT DOCUMENTS

| | | | |
|---|---|---|---|
| EP | 0 093 628 | A2 | 11/1983 |
| EP | 1439610 | A2 | 7/2004 |

(Continued)

OTHER PUBLICATIONS

European Search Report, Mail Date, Dec. 11, 2014, EP 14 17 7785, Application No. 14177785.4-1801.

*Primary Examiner* — Alexander Gilman

(57) ABSTRACT

A connector system, keying member and method for electrically connecting a post to a connector. The system includes a terminal post, a connector and a keying member. The connector has a housing body with a post receiving passage for receiving the terminal post therein. The housing body has a keying member receiving recesses provided proximate a first end of the post receiving passage. A keying member is positioned on the terminal post and maintained thereon. The keying member is configured to be positioned in the keying member receiving recesses when the connector is properly inserted onto the terminal post. The keying member prevents the mating of an improper connector onto a respective post.

11 Claims, 11 Drawing Sheets

(56) References Cited

U.S. PATENT DOCUMENTS

| | | | | |
|---|---|---|---|---|
| 5,752,839 | A * | 5/1998 | Fiacco et al. | 439/63 |
| 5,876,231 | A * | 3/1999 | Pacher | 439/354 |
| 5,915,758 | A * | 6/1999 | Alfiero | 29/854 |
| 6,183,904 | B1 * | 2/2001 | Kuboshima et al. | 429/178 |
| 6,341,972 | B1 * | 1/2002 | Odorfer | 439/352 |
| 6,764,318 | B1 * | 7/2004 | Fajardo | 439/82 |
| 6,817,893 | B2 * | 11/2004 | Schmid et al. | 439/522 |
| 9,059,542 | B2 * | 6/2015 | Oh et al. | 1/1 |
| 2013/0090000 | A1 * | 4/2013 | Zhao | 439/370 |

FOREIGN PATENT DOCUMENTS

| | | | |
|---|---|---|---|
| EP | 1737082 | A2 | 12/2006 |
| FR | 2 941 819 | A1 | 8/2010 |
| WO | 2013 / 052571 | A1 | 4/2013 |

* cited by examiner

QUICK CONNECT POWER CONNECTOR ISOLATING SYSTEM

FIELD OF THE INVENTION

The present invention is directed to an electrical connector which provides a quick, simple and reliable connection to mating posts. In particular, the invention is directed to an isolation or keying member which prevents the mating of a respective electrical connector to a post having different electrical properties, e.g. polarity, amperage, voltage.

BACKGROUND OF THE INVENTION

Electrical connectors for military, aviation, vehicular and other applications which required power must be able to withstand the environmental conditions, such as high vibrations, to which such connectors are subjected. The connectors also must provide high quality electrical connection through very broad ranges of temperature variations.

In various applications, connectors and posts may be used to supply the power and/or ground connections required. These posts and connectors can be used to carry different amperage and/or different voltage, depending upon the requirements of the system. These electrical connectors may also be required to accommodate extremely high amperage.

Therefore, it is imperative that when installing the electrical connectors onto the posts, only connectors with consistent electrical properties with the mating post, e.g. polarity, amperage, voltage, be allowed to be placed in electrical engagement. Mating of a respective electrical connector with an improper post can cause a system failure and result in a hazardous, and potentially life threatening, situation.

It would, therefore, be beneficial to have isolation or keying members which facilitate a quick, simple and reliable connection of the connectors to the posts and which ensure for a safe and effective electrical connection between the connectors and the posts regardless of the environmental conditions.

SUMMARY OF THE INVENTION

In view of the above, it is an object of the subject invention to provide a connector system, method and keying member which permits a quick, simple and reliable connection between an electrical connector and a mating post only when electrical connector and the mating post have compatible electrical characteristics.

It is another object of the subject invention to provide a connector system, method and keying member which prohibits the connection between an electrical connector and a mating post when the electrical connector and the mating post do not have compatible electrical characteristics.

It is another object of the subject invention to provide a connector system, method and keying member which is effective for a high amperage electrical connector.

It is another object of the subject invention to provide a connector system, method and keying member which ensures that a properly mated connector is fully inserted onto the post, thereby ensuring that a positive electrical connection is provided and maintained.

It is another object of the subject invention to provide a connector system, method and keying member with a position assurance member to ensure that a positive electrical connection is provided and maintained.

It is another object of the subject invention to provide a connector system, method and keying member with a visual indication which provides a quick and cost effective means to confirm that the connection is secured.

It is another object of the subject invention to provide a connector system, method and keying member which does not require tooling to install.

It is another object of the subject invention to provide a connector system, method and keying member which allows the connector to be inserted onto the post from any direction, thereby allowing the connector to be terminated to the post regardless of orientation.

It is another object of the subject invention to provide a connector system, method and keying member which allows the electrical connection to remain secure regardless of vibration or other environmental conditions.

An embodiment is directed to a connector system, which includes a terminal post, a connector and a keying member. The connector has a housing body with a post receiving passage for receiving the terminal post therein. The housing body has a keying member receiving recesses provided proximate a first end of the post receiving passage. A keying member is positioned on the terminal post and maintained thereon. The keying member is configured to be positioned in the keying member receiving recesses when the connector is properly inserted onto the terminal post. The keying member prevents the mating of an improper connector onto a respective post.

An embodiment is also directed to a keying member for use on a terminal post. The keying member includes a positioning member which cooperates with a positioning shoulder of the post to properly position the keying member relative to the post. A keying projection extends from the positioning member. The keying projection cooperates with a projection receiving recess of a connector which is mated to the post, the use of the keying member ensures that only a connector with desired electrical characteristics is mated to a post with similar electrical characteristics ensuring for a proper, reliable and safe electrical connection.

An embodiment is also directed to a method of positioning a connector on a post. The method includes: inserting a keying member onto the post; retaining the keying member on the post; inserting the connector onto the post; engaging the keying member with the connector; and properly seating connector on the post if keying member properly mates with a keying receiving recess of the connector. The keying member ensures that only a connector with desired electrical characteristics is mated to a post with similar electrical characteristics ensuring that a proper, reliable and safe electrical connection is provided.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
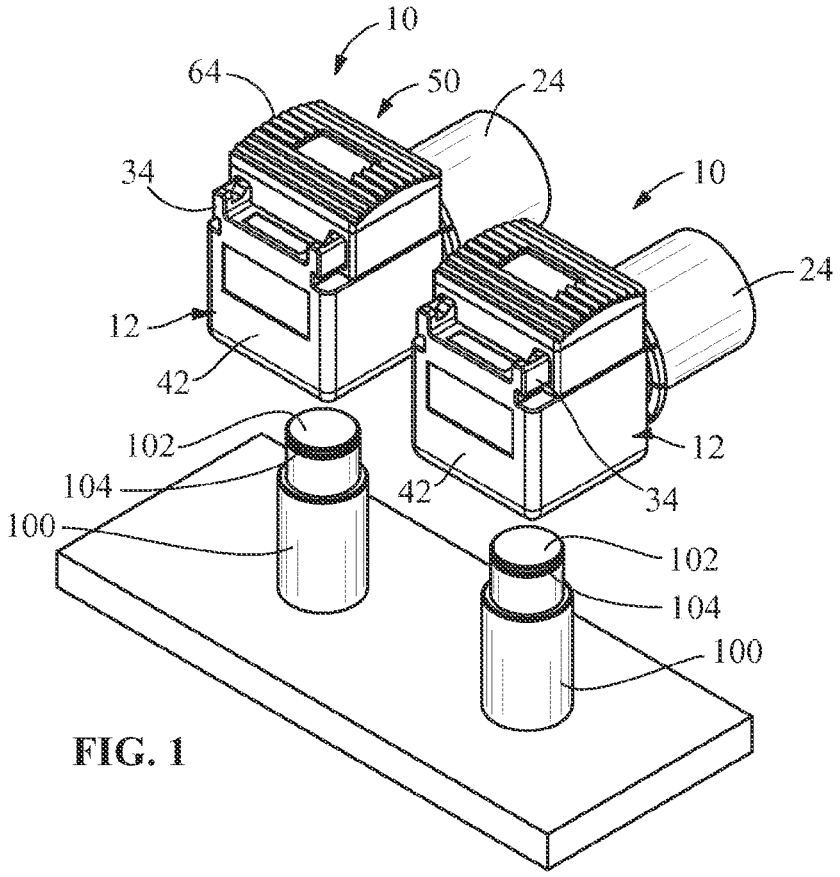
FIG. 1 is a perspective view of an illustrative embodiment of two quick connect power connectors prior to mounting to mating posts.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
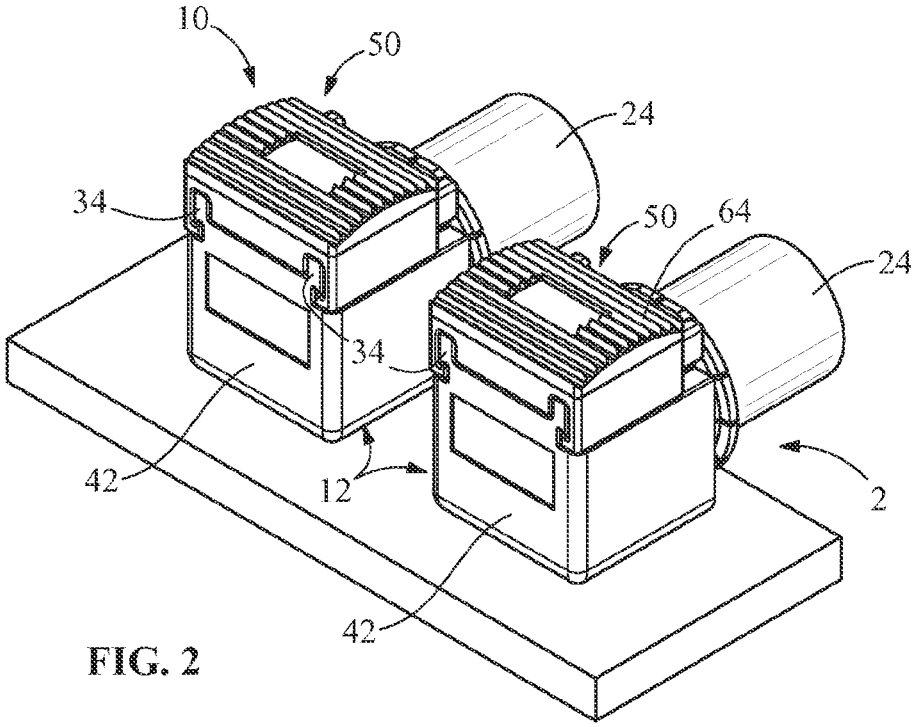
FIG. 2 is a perspective view of the connectors fully mated to the mating posts.

FIG. 1 shows a perspective view of two electrical connectors or plugs 10 prior to insertion on male posts or mating pins 100. FIG. 2 illustrates the connectors 10 fully mated to the posts 100. The electrical connectors 10 and posts 100 are shown as illustrative representations. The particular configuration of the connectors 10 and posts 100 may vary without departing from the scope of the invention. While two connectors 10 are shown, any number of connectors can be used without departing from the scope of the invention. The connectors 10 can be used for power or ground depending upon the desired application. In addition, connectors 10 can be configured to be used in applications having different voltages and/or amperage requirements.

Referring to FIGS. 3 through 9, each electrical connector 10 has a housing body 12 with a post receiving passage 14 for receiving a respective post 100 therein. The electrical connector 10 has a first or top end 16 and an oppositely facing second or bottom end 18 which has an opening 20 to receive the post 100 therethrough. The opening 20 extends to the post receiving passage 14. A conductor or wire receiving sidewall 22 extends between the first end 16 and the post receiving end 18. A conductor or wire (not shown), is inserted into a conductive wire receiving member 24 which extends from the sidewall 22 and is terminated thereto by crimping or other known termination methods. An insulation receiving recess 26 extends circumferentially around the conductive wire receiving member 24. The insulation receiving recess 26 allows an insulator, such as, but not limited to, a boot, to be installed over the conductive wire receiving member 26, thereby insulating the conductive wire receiving member 24 from other components and the operator.

Figure 6:
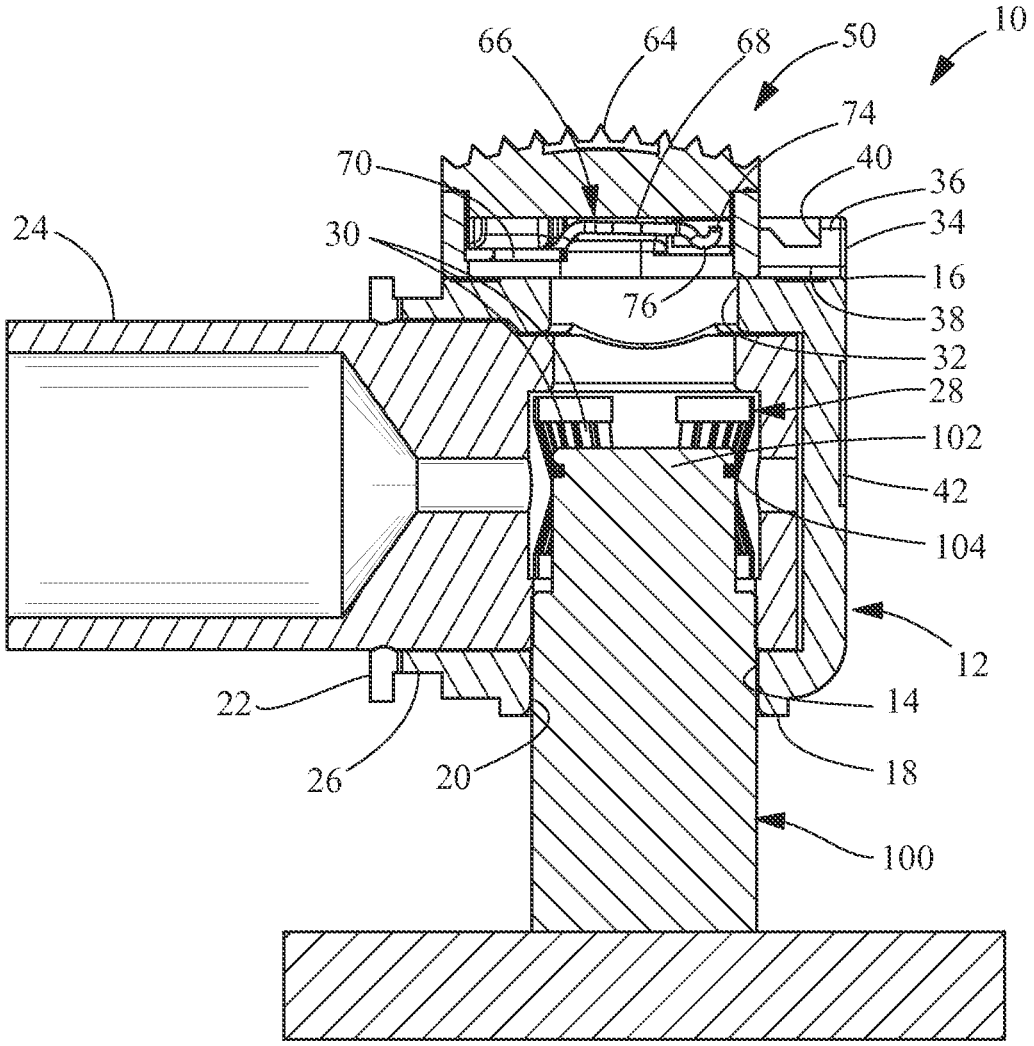
FIG. 6 is a cross-sectional view of the connector in alignment with a mating post, illustrating the connector prior to the mating post engaging the locking slide.

A contact 28 is positioned in the post receiving passage 14. In the embodiment shown, the contact 28 is a band which extends around the circumference of the passage 14. The band has resilient contact arms 30 which extend into the passage 14 (as best shown in FIG. 6). As the post 100 is inserted into the passage 14, the contact arms 30 are resilient deformed and are placed in electrical contact with the post 100. The contact 28 is positioned in the passage 14 such that the contact 28 will be placed in electrical engagement/contact with the post 100 regardless of the orientation of the contact 28 with respect to the post 100. This allows the wire receiving member 24 to be oriented at any position about the circumference of the post 100. The contact 28 and method of connecting the contact 28 to the post 100 are known in the industry. The conductor and wire provided in the wire receiving passage 26 is electrically connected to the contact 28 using known methods of termination. While the contact 28 is shown in the form of a band, other types of contacts can be used without departing from the scope of the invention.

A terminal post receiving opening 32 extends through the first or top end 16 of the body 12 of the connector 10. The opening 32 is positioned in alignment with post receiving passage 14. The opening 32 is dimensioned to receive a free or top end 102 of the post 100 therein.

Figure 3:
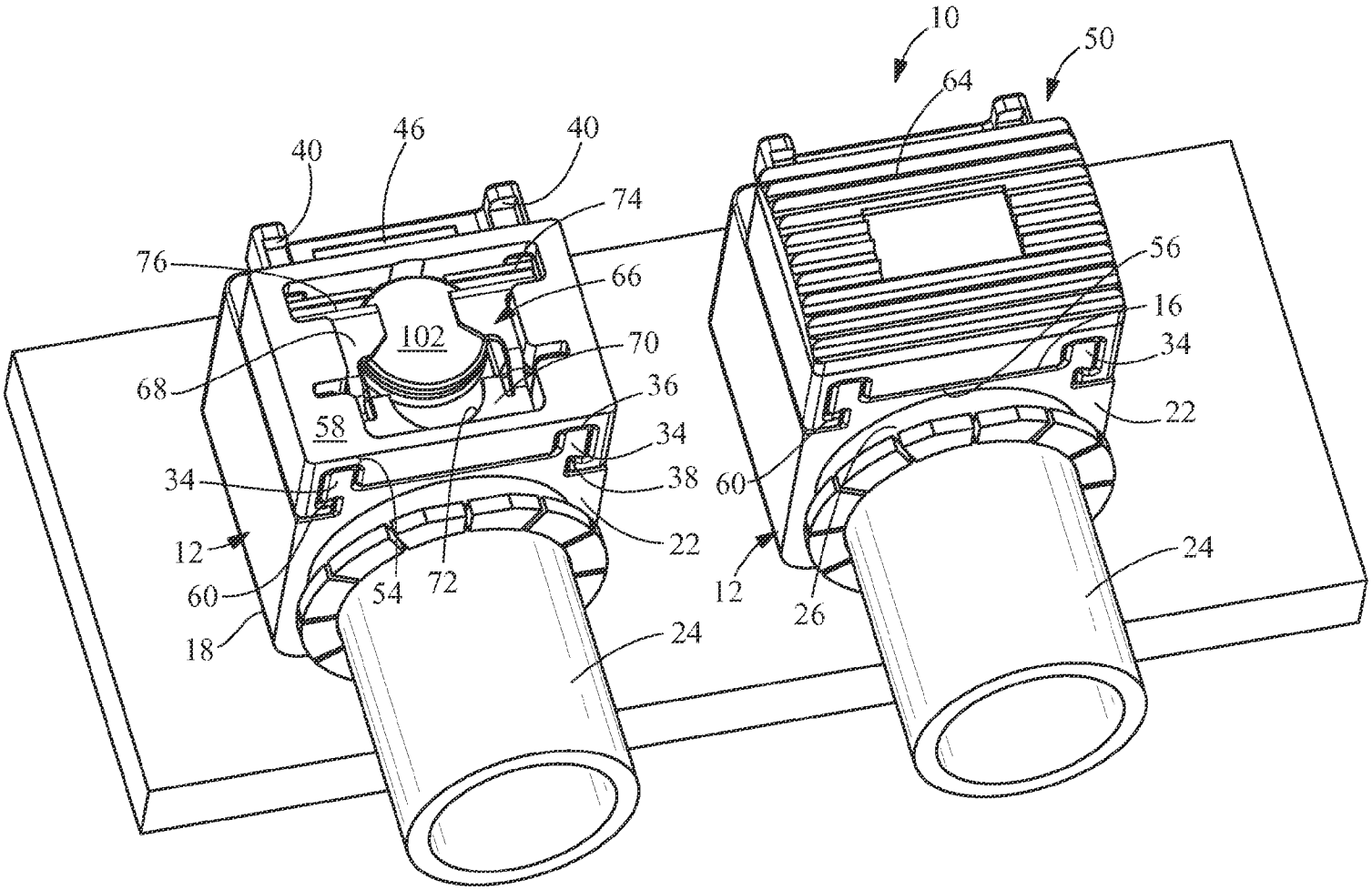
FIG. 3 is a perspective view of the connectors of FIG. 1 positioned on the mating post, illustrating locking slides of the connectors in an open position, one of the connectors has a cover of the locking slide removed for ease of understanding.
Figure 4:
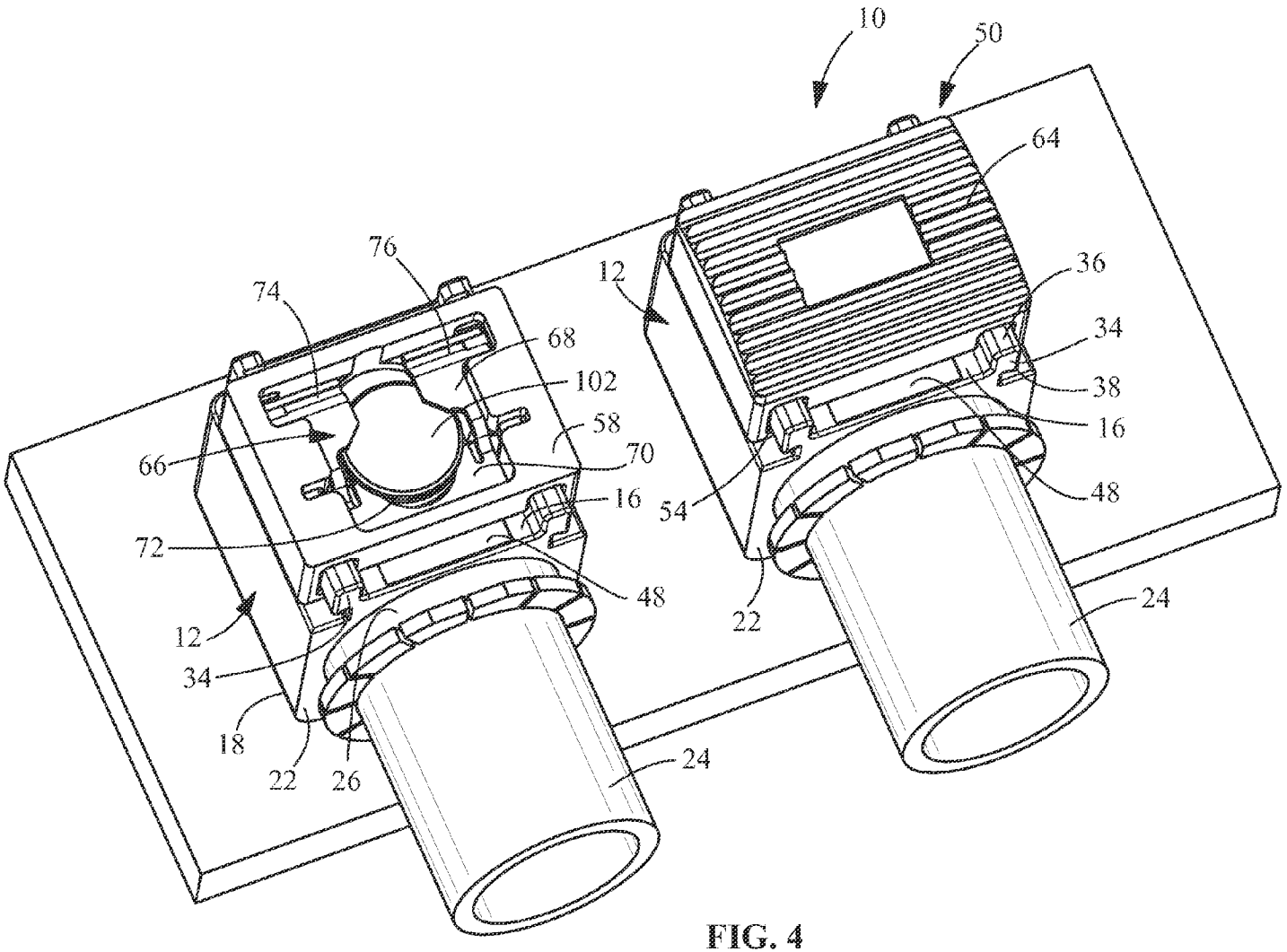
FIG. 4 is a perspective view of the connectors, similar to that of FIG. 3, illustrating the locking slides of the connectors in a transition position between an open position and a locked position, one of the connectors has the cover of the locking slide removed for ease of understanding.
Figure 5:
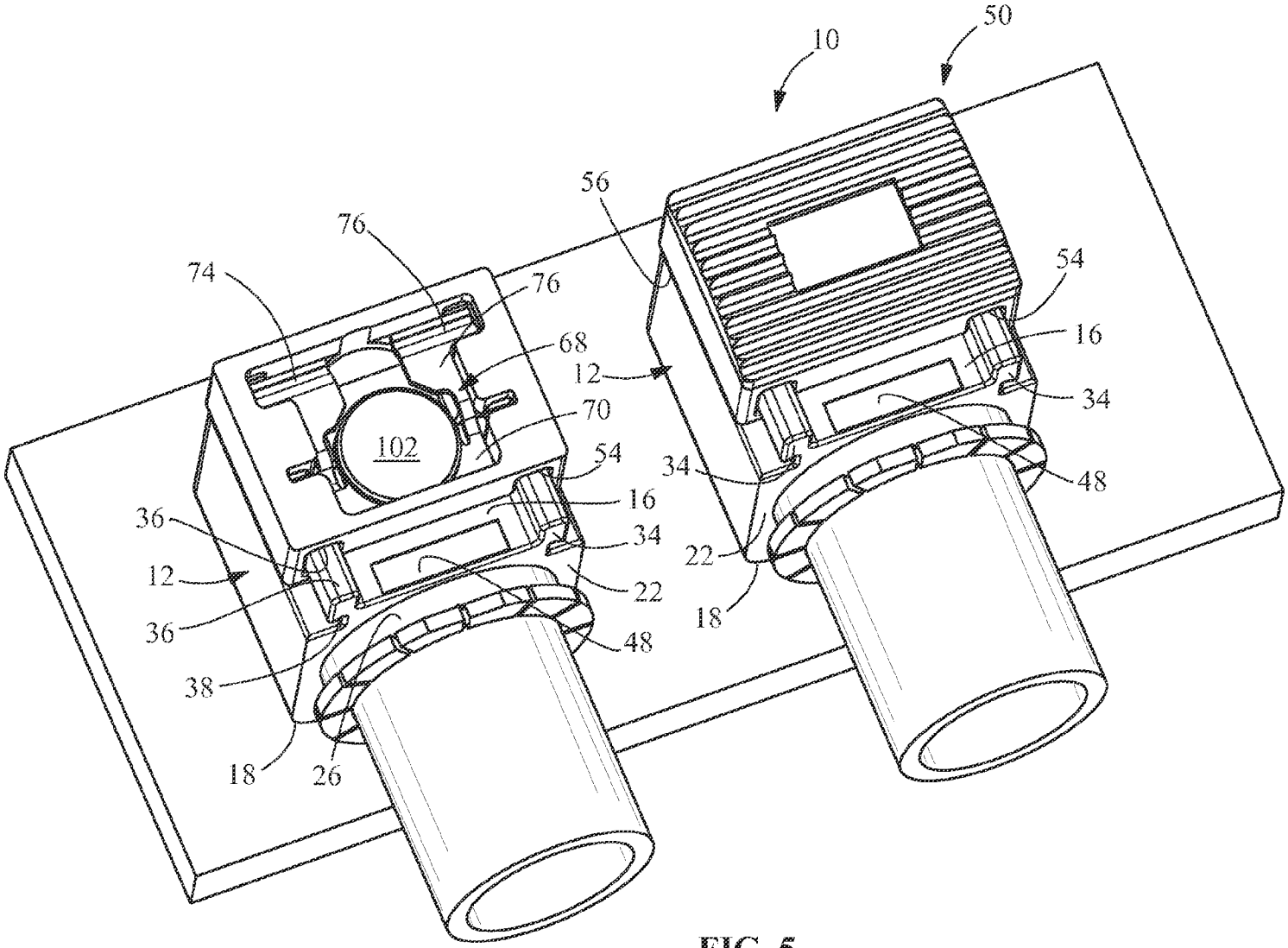
FIG. 5 is a perspective view of the connectors similar to that of FIG. 3, illustrating the locking slides of the connectors in fully locked position, one of the connectors has the cover of the locking slide removed for ease of understanding.
Figure 10:
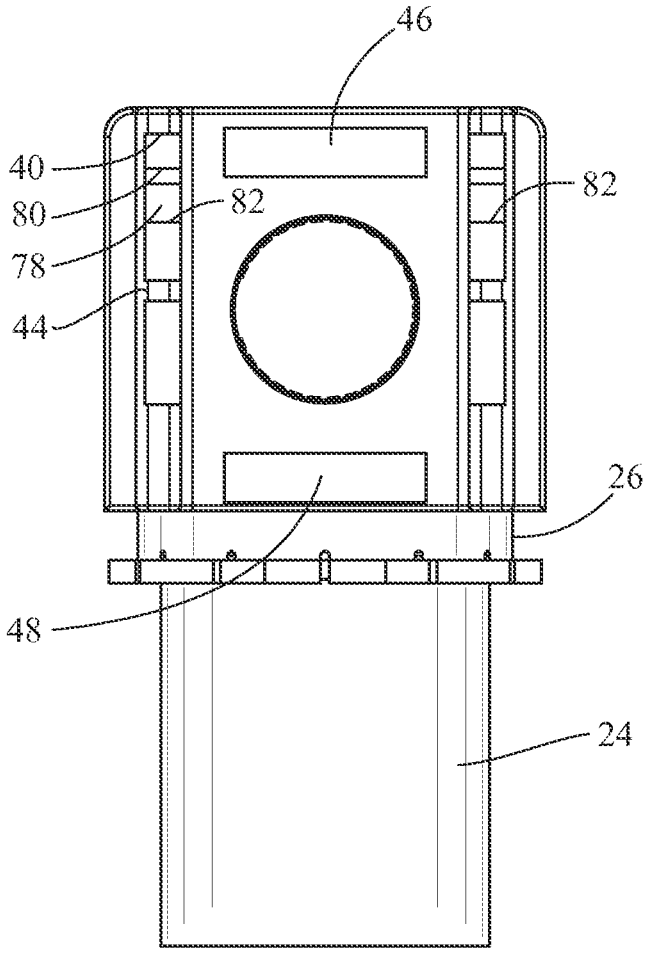
FIG. 10 is a top view of a housing of the connector with the locking slide removed.

Projections or tracks 34 (as best shown in FIG. 10) extend from the end 16 is a direction away from end 18. The tracks 34 are provided on either side of opening 32 and, in the embodiment shown, extend essentially the entire width of the connector 10. Each track 34 has a top surface 36 and an oppositely facing bottom surface 38 (as best shown in FIGS. 3 through 5). Each track 34 includes a stop surface or projection 40 positioned proximate a sidewall 42 of the connector 10 which is essentially opposed to the sidewall 22. A slot 44 is provided in each track 34 and is spaced from the stop surface 40 at a position between the sidewall 22 and the sidewall 42.

A first reference member or visual indicator 46 is provided on the top end 16 of the connector 10. The first visual indicator 46 is provided proximate sidewall 42. In the embodiment shown, the first visual indicator 46 is a red colored box; however other types of indicators (e.g. textured or raised areas) and other colors can used without departing from the scope of the invention. A second reference member or visual indicator 48 is provided on the top end 16 of the connector 10. The second visual indicator 48 is provided proximate sidewall 22. In the embodiment shown, the second visual indicator 48 is a green colored box; however other types of indicators (e.g. textured or raised areas) and other colors can used without departing from the scope of the invention.

A locking slide 50 is slidably mounted to the end 18 of connector body 12. The locking slide 50 has an opening 52 which receives the top end 102 of the post 100 therein. The opening 52 is dimensioned to be larger than the top end 102 of the post 100 to allow the locking slide 50 to move relative to the top end 102 of the post 100, as will be more fully described.

Figure 11:
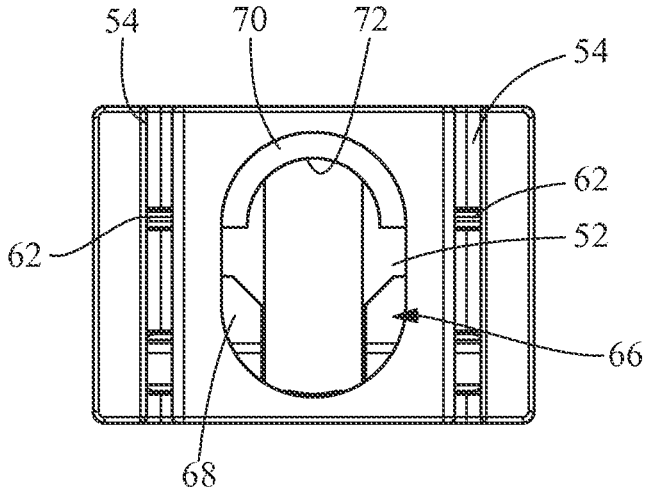
FIG. 11 is a bottom view of the locking slide prior to be positioned on the housing of the connector.

Track receiving recesses 54 (as best shown in FIG. 11) extend from a bottom surface 56 of locking slide 50 toward a top surface 58. The track receiving recesses 54 are provided on either side of opening 52 and, in the embodiment shown, extend essentially the entire width of the locking slide 50. Each track receiving recesses 54 has a projection 60 which is dimensioned to cooperate with the bottom surface 38 of the track 34, as best shown in FIGS. 3 through 5. Each recess 54 include a hold projection 62 which extends therein. The projections 62 are provided in the recesses at a position between the sidewall 22 and the sidewall 42.

A gripping surface 64 is provided on the top surface 50. In the embodiment shown, the gripping surface 64 is a series of projections and recesses. However, any type of surface which facilitates and operator moving the locking slide 50 between an open position and a closed position can be used without departing from the scope of the invention.

Figure 12:
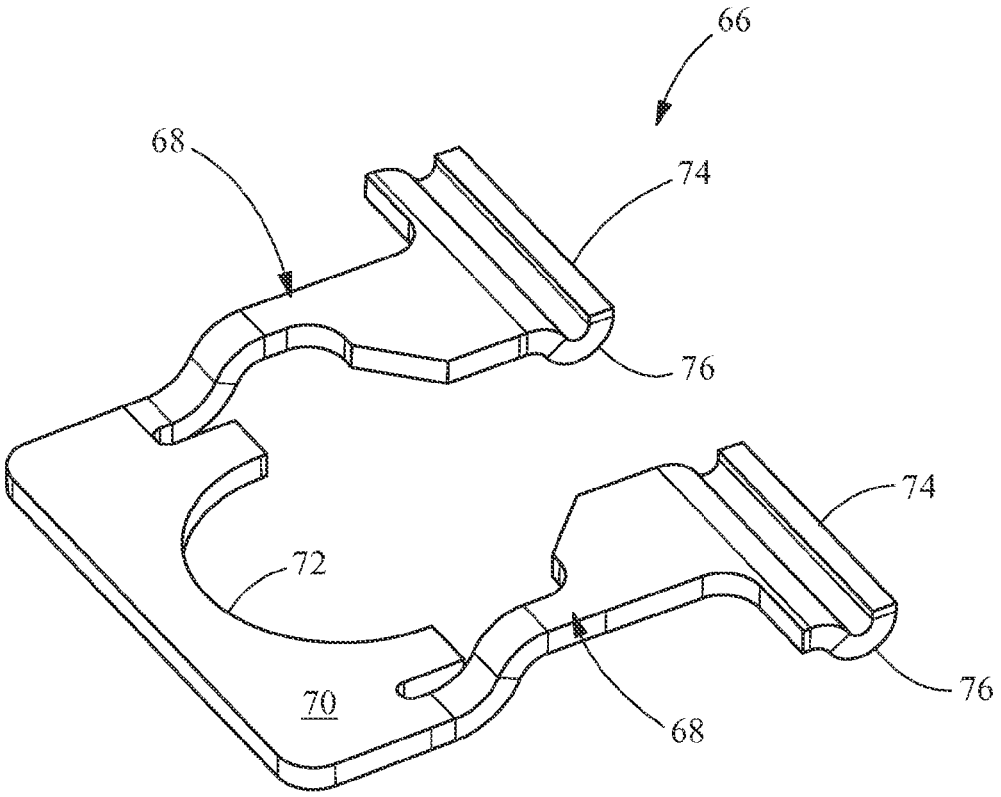
FIG. 12 is a perspective view of a locking clip which is housed in the locking slide.
Figure 13:
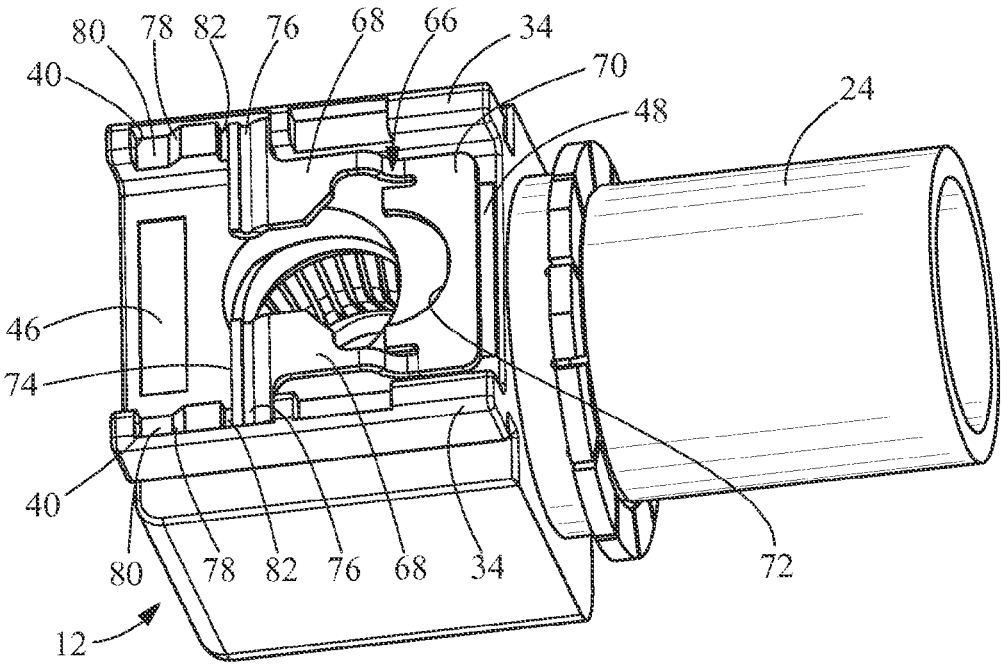
FIG. 13 is a perspective view of the connector with a portion of the locking slide removed to better shown the locking latch of the locking slide and the tracks of the connector body.

A locking latch 66 is housed in the locking slide 50. The locking slide may be overmolded over the locking latch. Alternatively, the locking latch 66 may be retained in the locking slide 50 by known securing techniques. The locking latch 66 is securely maintained in the locking slide 50, whereby the locking latch 66 moves together with the locking slide 50. As best shown in FIG. 12, the locking latch 66 has a pair of resilient latching arms 68 which extend from a locking section 70. The locking section 70 has a radiused locking surface 72 which cooperates with the post 100, as will be more fully described.

The resilient latching arms 68 extend from the locking section 70 and are mounted in the locking slide 50 to allow the resilient latching arms 68 to be resiliently deformed toward the top surface 58 of the locking slide 50. The resilient latching arms 68 are spaced from each other to allow the top end 102 of post 100 to be inserted therebetween. Proximate free ends 74 of the resilient latching arms 68 are radiused sections 76. The radiused sections 76 are configured to allow the radiused sections 76 to engage portions of the tracks 34 without damaging the tracks 34. Other configurations of the radiused sections 76 may be used without departing from the scope of the invention.

When the electrical connector 10 is mated with the mating post 100, the post 100 is received within the post receiving passage 14 of the electrical connector 10, as best shown if FIGS. 6 through 9.

FIG. 6 shows a cross-sectional view of the electrical connector 10 as the electrical connector 10 is being mated with the post 100. This view illustrates the post 100 positioned in the post receiving passage 14 prior to engaging the locking slide 50. The locking slide 50 is shown in the open or prelocked position. In this position, the locking latch 66 is in a normal or undeflected position. In this position, the locking slide 50 is positioned proximate sidewall 22. As locking slide 50 is positioned proximate sidewall 22, the locking slide 50 covers second visual indicator 48 and exposes first visual indicator 46. This provides the operator with a visual indication that the locking slide 50 is in the open or prelocked position. In this open or prelocked position, projections 62 of the track receiving recesses 54 are positioned in the slots 44 of the tracks 34. The cooperation of the projections 62 with the slots 44 secures the locking slide 50 in the open or prelocked position, thereby preventing the locking slide 50 from being inadvertently moved to closed or locked position.

Figure 7:
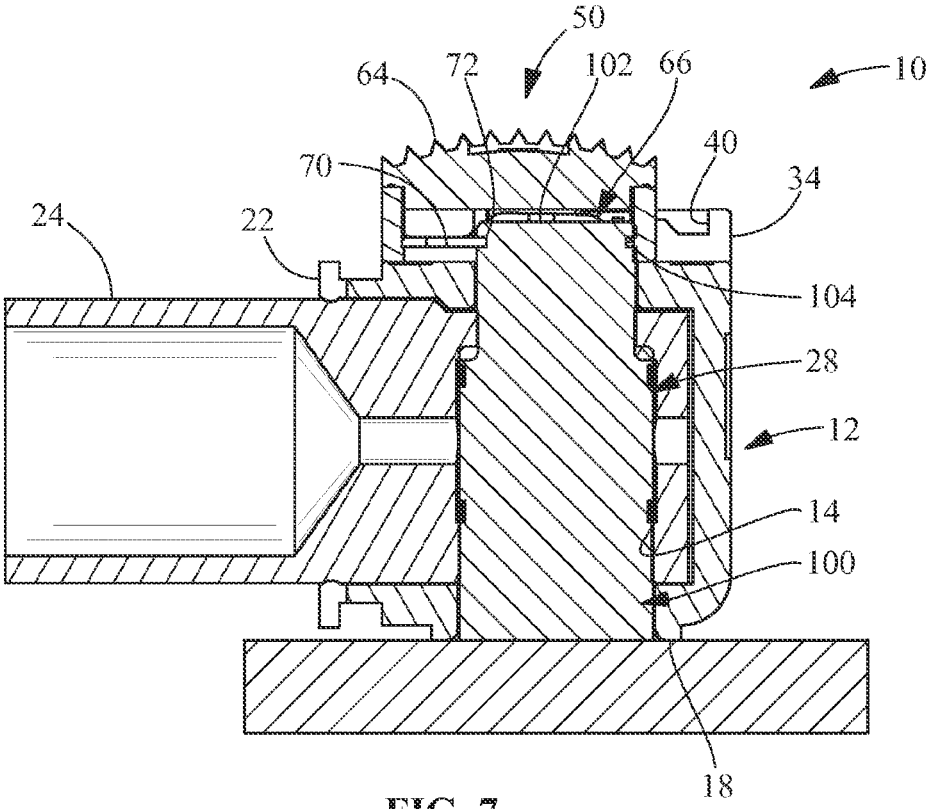
FIG. 7 is a cross-sectional view of the connector of FIG. 3, illustrating the connector in the open position.

As insertion of the post 100 into the post receiving passage 14 continues, the top end 102 of post 100 moves through opening 32 and between latching arms 68, as best shown in FIG. 7. As this occurs, the top surface 102 of the post 100 engages the top wall 58 of the locking slide 50. The engagement of the top surface 102 with the top wall 58 causes the locking slide 50 to move away from the top end 16 of the body 12. This movement is controlled and limited by the cooperation of the engagement of the projections 60 of the track receiving recesses 54 of the locking slide 50 with the bottom surfaces 38 of the tracks 34 of the body 12 of the connector 10. This limited movement of the locking slide 50 relative to the tracks 34 allows the projections 62 of the recesses 54 to be moved from the slots 44 of the tracks 34.

Figure 8:
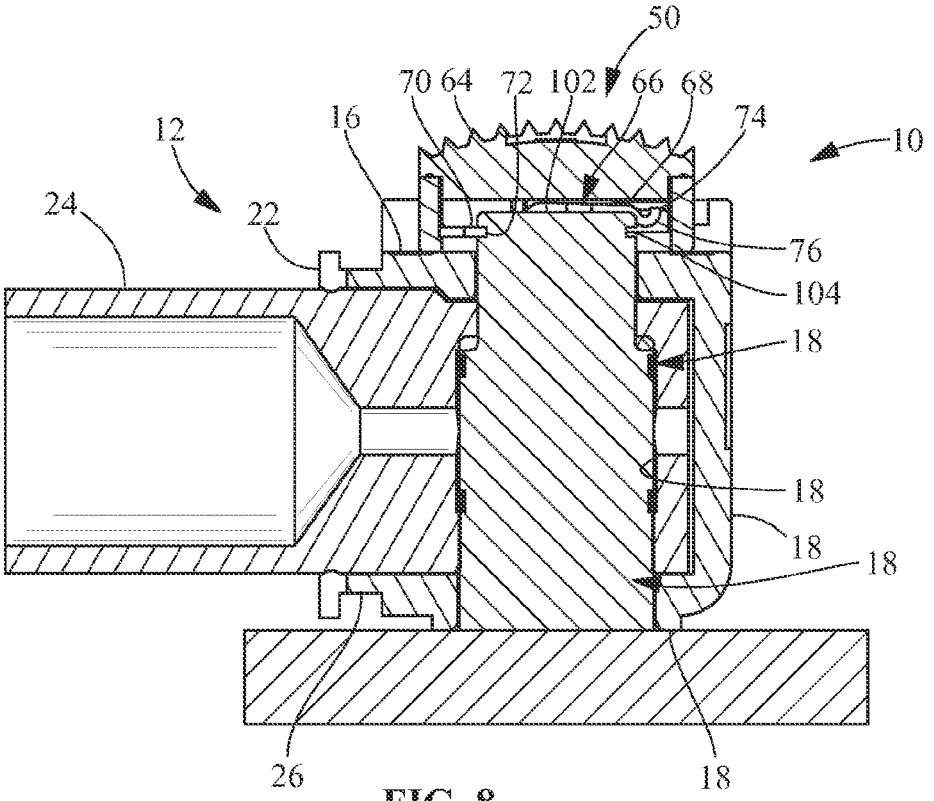
FIG. 8 is a cross-sectional view of the connector of FIG. 4, illustrating the connector in the transition position.
Figure 9:
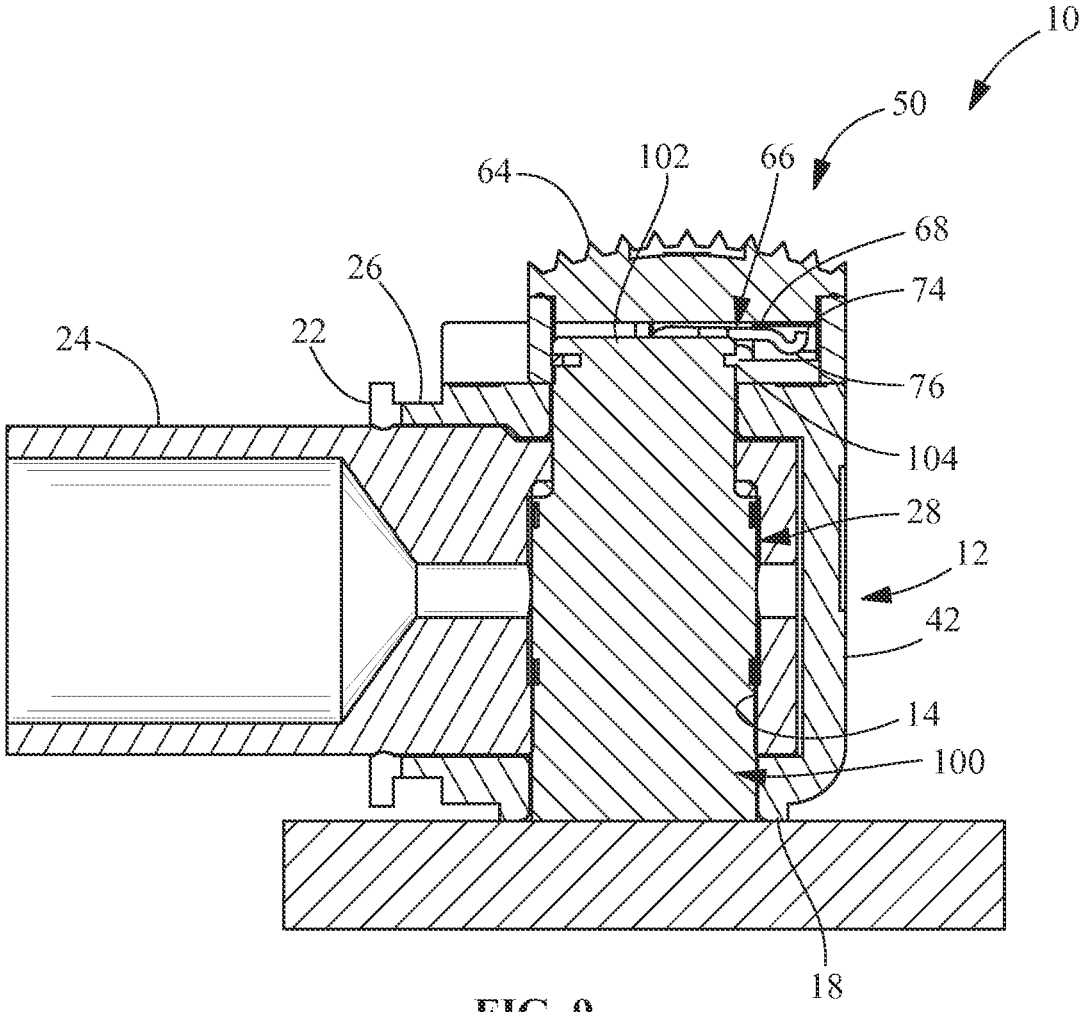
FIG. 9 is a cross-sectional view of the connector of FIG. 5, illustrating the connector in the closed or locked position.

With the projections 62 moved from the slots 44, the locking slide 50 can be moved from the prelocked or open position (FIGS. 3 and 7) to the transition position (FIGS. 4 and 8) and then to the closed or locked position (FIGS. 5 and 9). However, if the connector 10 is not properly mated with the post 100, the locking slide 50 will not be allowed be moved to the closed or locked position, as will be described.

As the locking slide 50 is moved from the prelocked or open position of FIG. 7 to the transition position of FIG. 8, the locking surface 72 of the locking section 70 of the locking latch 66 is moved toward the post 100. As movement of the locking slide 50 continues, the locking surface 72 is positioned in a locking surface receiving recess 104 of post 100. In the embodiment shown, the recess 104 extends circumferentially about the surface of the post 100 proximate end 102. As the recess 104 extends about the entire circumference of the post 100, the locking surface 72 can engage the recess 104 of the post 100 regardless of the orientation of the connector 10 with respect to the post 100. This allows the wire receiving member 24 to be oriented at any position about the circumference of the post 100. With the post 100 properly inserted into the connector 10, the locking surface 72 is moved into the recess 104 which allows the locking latch 66 and the locking slide 50 to be moved to the fully locked position, as shown in FIG. 9. However, if the post 100 is not fully inserted, the locking surface 72 will not be aligned with the recess 104. Additionally, the top end 102 of post 100 will not cause the resilient latching arms 66 to be moved toward the top surface 58 of the locking slide 50. In this position, the free ends 74 of the latch arms 66 abut or engage stop surfaces or walls 82 of tracks 34. Consequently, the locking slide 50 cannot be placed in the closed or locked position as the free ends 74 of the latch arms 66 will engage walls 82 to prevent the continued movement of the locking latch 66 and locking slide 50 toward the locked position. This prevents the connector 10 from being improperly inserted onto the post 100.

With the post 100 properly inserted, the top end 102 of post 100 engages the resilient latching arms 66. The causes the resilient latching arms 66 and the free ends 74 to be moved toward the top surface 58 of the locking slide 50, allowing the free ends 74 to move above walls 82. This allows the continued movement of the locking slide 50 toward the closed or locked position (FIG. 9) to continue, allowing the locking surface 72 to be moved into the recess 104. As insertion continues, the resilient latching arms 68 are moved beyond the inclined surfaces 78 and into recesses 80 which allow the latching arms 68 to return toward an unstressed position. Further movement of the locking slide 50 toward the sidewall 42 is prevented, as the radiused sections 76 engage the stop projections 40 of the tracks 34 to prevent further unwanted movement of the locking slide 50.

The positioning of the radiused sections 76 in the recesses 80 also prevents the unwanted movement of the locking slide 50 and locking latch 66 back toward the open position. Consequently, as the locking slide 50 and locking latch 66 are retained in the closed or locked position, environmental conditions, such as, but not limited to, vibration, do not result in the inadvertent or unwanted electrical disengagement of the connector 10 from the post 100. This ensures that a positive electrical connection will be maintained.

When the locking slide 50 is in the open position, the locking slide 50 is position proximate sidewall 22. In this position the second visual indicator 48 is covered and the first visual indicator 46 is exposed, providing the operator a visual indication that the locking slide 50 is in the open or prelocked position. When the locking slide 50 is in the closed or locked position, the locking slide 50 is position proximate sidewall 42. In this position the second visual indicator 48 is exposed and the first visual indicator 46 is covered, providing the operator a visual indication that the locking slide 50 is in the closed or locked position. When the locking slide 50 is in the transition position, the locking slide 50 is position between sidewall 42 and sidewall 22. In this position neither the second visual indicator 48 nor the first visual indicator 46 is fully exposed, providing the operator a visual indication that the locking slide 50 is not properly positioned in the closed or locked position. This allows the operator to visually determine if the connectors 10 are fully mated or only partially mated to the posts 100.

The use of the visual indicators are easily detectable by either the human eye, a bar code type reader, a UV scanner or other device, thereby allowing for a positive indication to assure that the connector 10 is fully mated to mating post 100. For example, if ink of a contrasting color, laser marking and/or a UV tracer are used for the visual indicators, a hand held scanner can be used to determine if the connectors 10, 100 are fully mated even in blind mate areas.

The posts 100 and connectors 10 can be used for power or ground connections. In addition, the posts 100 and connectors 10 can be used to carry different amperage and/or different voltage. It is, therefore, essential that only connectors with similar electrical properties/characteristics be allowed to mate with respective posts. By limiting the mating capabilities between respective connectors 10 and posts 100, a proper, optimum, reliable and safe electrical connection is ensured.

Figure 14:
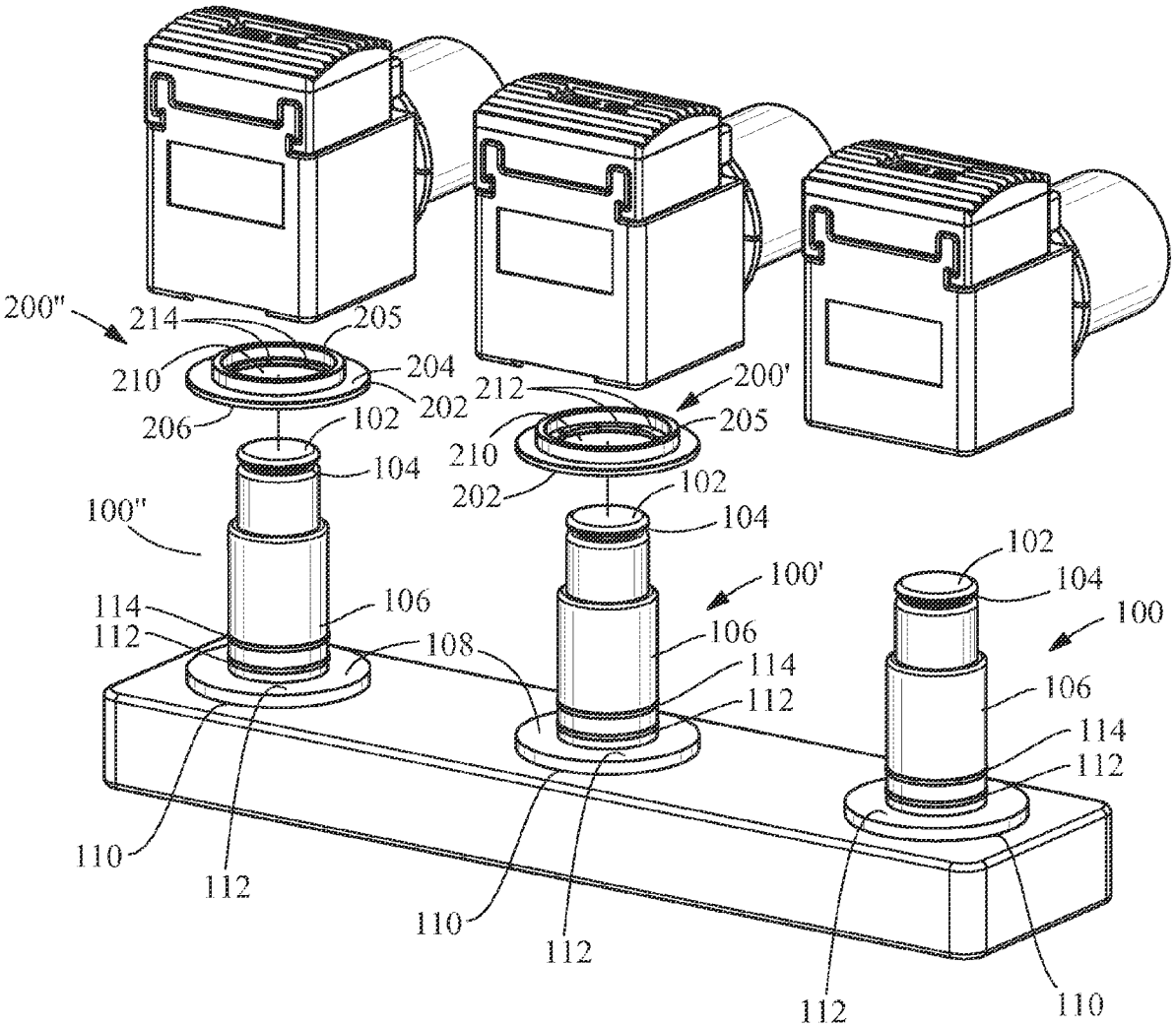
FIG. 14 is a perspective exploded view of an illustrative embodiment of three connectors and posts, with the first post having not keying member associated therewith, the second post having a first embodiment of a keying member exploded therefrom, and the third post having a second embodiment of a keying member exploded therefrom.
Figure 15:
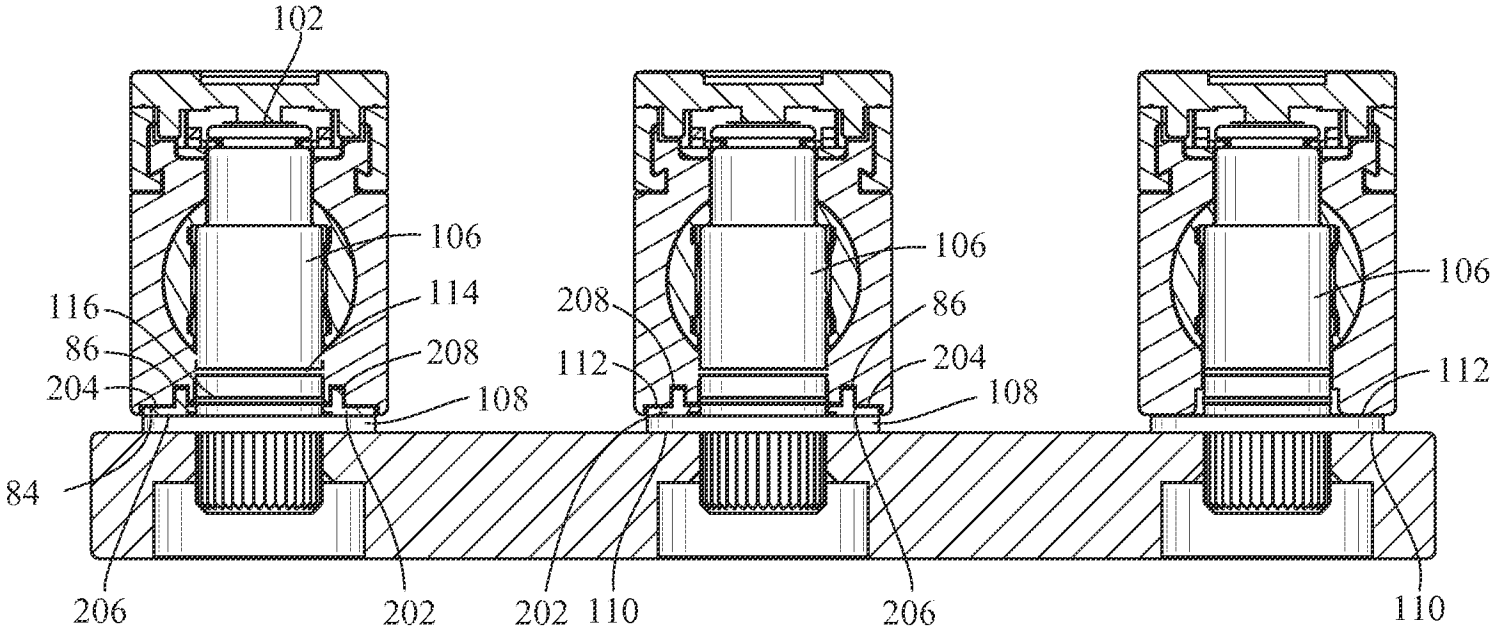
FIG. 15 is a cross-sectional view of the connectors, posts and keying members of FIG. 14 shown in the fully mated position.

Referring to FIGS. 14 and 15, a connector system having a connector 10, post 100 and keying member 200 is shown. While connector 10 is shown, connector 10 is an illustrative embodiment and the claims are not intended to be limited to the embodiment of the connector shown and described.

As best shown in FIG. 15, connector 10 has keying receiving relief or recess 84 which extends from the second or bottom end 18 of the body 12 of the connector 10 toward the first or top end 16 of the body 12. In the embodiment shown, the keying receiving recess 84 is positioned proximate the post receiving passage 14 and extends about the circumference of the post receiving passage 14. A projection receiving relief or recess 86 extends from the keying receiving recess 84 in a direction away from the bottom end 18 and toward the top end 16. In the embodiment shown, the projection receiving recess 86 is positioned proximate the post receiving passage 14 and extends about the circumference of the post receiving passage 14. The spacing of the projection receiving recess 86 from the post receiving passage 14 may vary, as will be further described below. Other embodiments of the keying receiving recess 84 and the projection receiving recess 86 may be used without departing from the scope of the invention.

Post 100 includes a bus mating end 106 which is positioned away from the top end 102. In the embodiment shown, the bus mating end 106 has a circumference which is larger than the circumference of the top end 102, however, other configuration can be used without departing from the scope of the invention. A positioning projection 108 extends about the circumference of the bus mating end 106. The positioning projection 108 has a first surface 110 and an oppositely facing second surface 112. The first surface cooperates with a substrate, circuit board, bus bar or other such component to properly seat the positioning projection 108 and the post 100 in position thereon. A first retaining recess 114 extends about the circumference of the mating end 106. The first retaining recess 114 is spaced from the positioning projection 108 in a direction toward the top end 102. A second locking recess 116 also extends about the circumference of the mating end 106. The second locking recess 116 is positioned between the positioning projection 108 and the first retaining recess 114. While the embodiment shown has both a first retaining recess 114 and a second locking recess 116, other embodiments may utilize only the locking recess 116.

Plastic, insulative or isolating keying members 200 are positioned on posts 100. In FIGS. 14 and 15, different keying members 200 are shown. Post 100 has no keying member 200 and is consistent with the posts shown in FIGS. 1 through 13. Post 100' has a first keying member 200' and post 100" has a second keying member 200". Keying members 200' and 200", generically referred to as 200, are representative embodiments of keying members 200 which cooperate with connectors 10 to ensures that only connectors with desired electrical properties/characteristics can be mated with respective posts with similar electrical properties/characteristics, as will be more fully described.

Keying members 200 have positioning members 202 which have first surfaces 204 and second surfaces 206. The first surfaces 204 are dimensioned to cooperate with the second surfaces 112 of the positioning projections 108 of posts 100 when the keying members 200 are fully inserted onto posts 100. Keying projections 208 extend from the second surfaces 206 of the positioning members 202 is a direction away from the first surfaces 204. An opening 210 is provided in each keying member 200. The openings 210 extend through the positioning members 202 and the keying projections 208 to allow the posts 100 to be inserted therethrough. The positioning members 202 extend about the circumference of openings 210. The keying projections 208 also extend about, but are spaced from, the circumference of openings 210 at varying distances. Resilient arms 212 which are spaced apart by spaces 214 extend into the openings 210 to cooperate with recesses 114, 116 of posts 100, as will be more fully described.

In use, the connector system uses the keying members 200 to ensure that only connectors with desired electrical properties/characteristics can be mated with respective posts with similar electrical properties/characteristics, thereby ensuring that a safe and effective electrical connection between the connectors and the posts is affected.

The keying member 200 is inserted onto the post 100 prior to the electrical connector 10 being mated to the post. The opening 210 accepts the post 100 therein and allows the keying member 200 to be inserted onto the post 100 toward the positioning projection 108 of the post 100. As this occurs, the resilient arms 212 of the keying member 200 are resiliently deformed. Insertion continues until the resilient arms 212 engage the first recess 114 of the post 100. As this occurs, the resilient arms 212 move toward an unstressed position, securing the resilient arms 212 in the first retaining recess 114 and thereby securing the keying member 212 to the post 100. In this position, the keying member 200 is not fully inserted onto the post 100, but is retained on the post 100, preventing the inadvertent removal of the keying member 200 from the post 100.

With the keying member 200 maintained on the post 100, the electrical connector 10 is inserted onto the post 100. As this occurs, the post 100 is received in the post receiving passage 14. As the connector is moved toward the positioning projection 108 of the post 100, the keying recess 84 engages the keying member 200. The continued insertion of the connector 10 forces the keying member 200 to be moved toward the positioning projection 108, thereby causing the resilient arms 212 to move from the first retaining recess 114 to the second locking recess 116. With the resilient arms 116 positioned in the second locking recess 116, the keying member 200 is positioned and retained in its final mating position. It should be noted that the post 100 may not include a first recess 114, thereby allowing the keying member 200 to be initially positioned in the second locking recess 116 prior to the insertion of the connector 10 onto the post 100.

With the keying member 200 properly positioned in second recess 116, the insertion of the connector 10 onto to the post 100 is continued. If the connector 10 has the appropriate electrical characteristics/properties, the keying projection 208 of the keying member 200 will align with the projection receiving recess 86 of the connector 10, allowing the connector 10 to be fully mated with the post 100. As previously described, in this fully mated position, the top end 102 of post 100 engages the resilient latching arms 66. The causes the resilient latching arms 66 and the free ends 74 to be moved toward the top surface 58 of the locking slide 50, allowing the free ends 74 to move above walls 82. This allows the continued movement of the locking slide 50 toward the closed or locked position (FIG. 9) to continue, allowing the locking surface 72 to be moved into the recess 104.

Alternatively, if the connector 10 does not have the appropriate electrical characteristics/properties, the keying projection 208 of the keying member 200 will not align with the projection receiving recess 86 of the connector 10, thereby preventing the connector 10 from being fully mated with the post 100. As previously described, in this position, the locking surface 72 will not be aligned with the recess 104. Additionally, the top end 102 of post 100 will not cause the resilient latching arms 66 to be moved toward the top surface 58 of the locking slide 50. In this position, the free ends 74 of the latch arms 66 abut or engage stop surfaces or walls 82 of tracks 34. Consequently, the locking slide 50 cannot be placed in the closed or locked position as the free ends 74 of the latch arms 66 will engage walls 82 to prevent the continued movement of the locking latch 66 and locking slide 50 toward the locked position. This prevents the connector 10 from being improperly inserted onto the post 100 with differing electrical characteristics/properties.

Many different configurations of the projection receiving recesses 86 and the keying projections 208 can be provided to provide for many different keying combinations. In order to provide for different combination, the projection receiving recesses 86 and the keying projections 208 may have, but are not limited to, different spacing, different shapes/configurations, different colors and/or other visual indicators which allow the connector 10 to be mated to an appropriate post 100 with an matching keying member 200. In addition, multiple, and/or different numbers projection receiving recesses 86 and keying projections 208 may be provided to facilitate further combinations.

The method of positioning a connector on a post, as described in the description above, includes: inserting a keying member onto the post; retaining the keying member on the post; inserting the connector onto the post; engaging the keying member with the post; and properly seating connector on the post if keying member properly mates with a keying receiving recess of the connector. The keying member ensures that only a connector with desired electrical characteristics is mated to a post with similar electrical characteristics ensuring that a proper, reliable and safe electrical connection is provided.

Prior to inserting the keying member onto the post, the colors of color coded projection receiving recesses 86 and color coded keying projections 208 may be checked to make certain that they match, thereby ensuring that only proper connectors 10 are inserted on proper posts 100. With the colors properly matched, the respective keying projection 208 can be properly and fully positioned in a corresponding respective receiving recesses 86, thereby ensuring that only proper respective connectors 10 are mated on proper respective posts 100.

Additionally, the method may include: inserting a keying member onto the post in a first position; engaging the keying member with the connector; and moving the keying member from a first position to a second position.

Additionally, the method may include: engaging keying projections of the keying members with projection receiving recess provided proximate the keying receiving recess.

Additionally, the method may include: engaging a latching arm of a locking latch with the post; moving the latching arm; and moving the locking latch to a locked position.

Additionally, the method may include: resiliently deforming resilient arms of the keying member as the keying member is inserted onto the post.

Additionally, the method may include: moving the resilient arms toward an unstressed position as the resilient arms engage a recess of the post, thereby retaining the keying member on the post.

The connector 10, system and method described herein provides a simple and reliable connector to mating posts and to the power bus to which the posts are connected. The connector is inserted onto the post making an electrical connection thereon. The use of the keying member ensures that only connectors with desired electrical characteristics are mated to posts with similar electrical characteristics ensuring that a proper, optimum, reliable and safe electrical connection is ensured.

The use of the keying member 200 prevents the full insertion of the post 100 into the connector 10 if the keying projection 208 and the projection receiving recess 86 of the connector 10 do not align or mate, thereby prohibiting the movement of the locking slide 50 to the locked position. However, if the keying projection 208 and the projection receiving recess 86 of the connector 10 properly align or mate and the connector 10 is properly inserted onto the post 100, the use of the locking slide ensures that the connector is fully inserted onto the post, thereby ensuring that a positive electrical connection is provided and maintained. The visual indication provides a quick and cost effective means to confirm that the connection is secured.

The configuration of the connector 10, the post 100 and the keying member 200 allow for the connector to be inserted onto the post 100 from any direction.

While the quick connect and disconnect connector can be used for many application with varying amperage, the configuration allows for, but is not limited to, use with high amperage electrical connections which require up to 1000 amps per contact.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector system, the connector system comprising:

a terminal post;

a connector having a housing body, the housing body having a post receiving passage for receiving the post therein, the housing body having a keying member receiving recess provided proximate a first end of the post receiving passage, the keying member receiving recess extending circumferentially about the post receiving passage;

a keying member positioned on the post and maintained thereon, the keying member having an opening for receiving the terminal post therein, the keying member having a keying projection extending circumferentially about the opening which is configured to align and be positioned in the keying member receiving recess when the connector and the keying member have appropriate electrical characteristics, allowing the connector be fully mated with the post;

wherein the keying projection of the keying member does not align with the keying member receiving recess when the connector and the keying member do not have appropriate electrical characteristics, preventing the connector be fully mated with the post.

2. The connector keying system recited in claim 1, wherein the keying member has a positioning member which cooperates with a positioning shoulder of the post to properly position the keying member relative to the post.

3. The connector keying system recited in claim 1, wherein the post has a recess which is spaced from a positioning shoulder of the post.

4. The connector keying system recited in claim 1, wherein the opening of the keying member has resilient arms which extend therein, the resilient arms cooperate with a recess on the post to maintain the keying member on the post.

5. The connector keying system recited in claim 1, wherein the keying member prevents the full insertion of the post into the connector if the keying projection and the projection receiving recess of the connector do not align or mate, thereby prohibiting a locking slide of the connector from moving to the locked position in which the connector is fully mated with the post.

6. The connector keying system recited in claim 1, wherein if the keying projection and the projection receiving recess of the connector properly align, a locking slide of the connector is moved to a latched position when the connector is fully inserted onto the post, thereby ensuring that a positive electrical connection is provided and maintained.

7. The connector keying system recited in claim 1, wherein the keying projection extends from the positioning member.

8. The connector keying system recited in claim 7, wherein the positioning member extends about and is spaced from a circumference of the opening which extends through the keying member.

9. The connector keying system recited in claim 1, wherein the connector and the keying member have visual indicators to ensure that the connector is mated with the proper post.

10. A keying member for use on a terminal post, the keying member comprising:

a positioning member which cooperates with a positioning shoulder of the post to properly position the keying member relative to the post, the positioning member having an opening for receiving the post therein, the opening having resilient arms which extend therein, the resilient arms cooperate with a first recess on the post and a second recess on the post to maintain the keying member on the post and allow the keying member to move between the first recess and the second recess;

a keying projection which extends from the positioning member, the keying projection extending circumferentially about the opening and configured to align and be positioned in a keying member receiving recess of a mating connector when the connector and the keying member have appropriate electrical characteristics, allowing the connector be fully mated with the post;

wherein the keying projection of the keying member does not align does with the keying member receiving recess when the connector and the keying member do not have appropriate electrical characteristics, preventing the connector be fully mated with the post.

11. The keying member recited in claim 10, wherein the keying projection is spaced from the circumference of the opening.

* * * * *